United States Patent [19]

Jansson et al.

[11] Patent Number: 4,970,770

[45] Date of Patent: Nov. 20, 1990

[54] METHOD OF MAKING A COATED HEAT EXCHANGER WITH TUBES AND FINS

[76] Inventors: Gösta Jansson, Betselvägen 23, S-552 59 Jönköping; Berndt Wadell, Vilbergsgatan 241, S-603 57 Norrköping; Per-Olof Jakobsson, Bokgatan 2, S-614 00 Söderköping, all of Sweden

[21] Appl. No.: 403,029

[22] Filed: Aug. 31, 1989

Related U.S. Application Data

[63] Continuation of Ser. No. 211,002, Jun. 24, 1988, abandoned, Continuation-in-part of Ser. No. 13,391, Feb. 11, 1987, abandoned.

[51] Int. Cl.[5] ..... B21D 53/02

[52] U.S. Cl. ..... 29/890.044; 29/460; 29/523; 29/890.047

[58] Field of Search ..... 29/157.3 A, 157.3 B, 29/157.3 C, 157.3 R, 157.4, 157.3 V, 460, 523, 527.4, DIG. 4; 427/327–330, 374.1, 372.2, 374.2, 374.3, 398.3; 165/133, 134.1

[56] References Cited

U.S. PATENT DOCUMENTS

| | | | |
|---|---|---|---|
| 1,818,592 | 8/1931 | Walworth . | |
| 2,458,189 | 7/1945 | Morgan | 113/118 |
| 3,268,989 | 8/1966 | Erwin et al. | 29/157.3 |
| 3,432,905 | 3/1969 | Monroe | 29/157.3 A |
| 4,034,453 | 7/1977 | Tomita et al. | 29/157.3 |
| 4,075,376 | 2/1978 | Jaeger | 428/36 |
| 4,197,625 | 4/1989 | Jahoda | 29/157.3 B |
| 4,269,267 | 5/1981 | Labrande | 165/181 |
| 4,519,121 | 5/1985 | Yokosawa | 29/157.3 B |

FOREIGN PATENT DOCUMENTS

| | | | |
|---|---|---|---|
| 3131737A1 | 4/1982 | Fed. Rep. of Germany . | |
| 1350826 | of 1964 | France . | |
| 1462224 | of 1966 | France . | |
| 8204485 | 5/1973 | France . | |
| 164168 | 8/1985 | Japan | 165/184 |
| 406498 | 3/1934 | United Kingdom . | |
| 1242968 | 8/1971 | United Kingdom . | |
| 1317983 | 5/1973 | United Kingdom . | |

OTHER PUBLICATIONS

"Finned Tubes in a Wide Variety of Designs Increase Heat-Exchange Efficiency", Power, Nov., 1964.

*Primary Examiner*—Joseph M. Gorski
*Assistant Examiner*—I. Cuda
*Attorney, Agent, or Firm*—Dann, Dorfman, Herrell & Skillman

[57] ABSTRACT

The invention relates to a heat-exchanger (10) incorporating circulation tubes (16) for conducting a first heat-transfer medium, end plates (12), and surface-enlarging plate-like fins (14) secured to the outer peripheral surfaces of the circulation tubes and arranged to be contacted with a second heat-transfer medium, the fins being firmly secured to a plurality of circulation tube sections, which extend through registering holes (18) formed in the fins (14). The fins are secured to the tube sections by expanding the tubes so as to enlarge the periphery thereof. The contact surfaces of the fins about the inside periphery of the holes (18) which engage against the circulation tubes (16) are cylindrical and extend parallel to the longitudinal axis of the circulation tubes over at least a greater part of the axial extent of the holes, which affords stable attachment and good heat-transfer properties. The tube sections may be interconnected to provide the desired flow path(s), by tube elbows welded to the projecting ends of the tube sections. The whole of the heat-exchanger (10) is coated with an impervious, protective surface layer, for example enamel, applied after the tube sections have been expanded to their final configuration.

13 Claims, 2 Drawing Sheets

METHOD OF MAKING A COATED HEAT EXCHANGER WITH TUBES AND FINS

RELATED APPLICATION

This application is a continuation of U.S. patent application Ser. No. 07/211,002, now abandoned, which is a continuation-in-part of U.S. patent application Ser. No. 013,391 filed Feb. 11, 1987, now abandoned.

FIELD OF THE INVENTION

The present invention relates to a tube heat-exchanger of the kind which incorporates batteries of heat-exchange fins, i.e., a heat-exchanger which comprises circulation tubes for conducting a first heat-exchange medium and having mounted on the outer peripheral surfaces of the tubes surface-enlarging plate-like fins around which a second heating -exchange medium is intended to flow, the tubes extending through holes formed in respective fins. More specifically, the invention relates to a method of producing heat exchangers of the kind in which the heat-transfer fins are secured firmly to the circulation tubes by expanding the tubes radially into firm engagement with the fins.

BACKGROUND OF THE INVENTION

The invention relates primarily to tube heat-exchangers of the aforesaid kind in which the medium intended to flow in the tubes is a liquid or optionally a medium which changes phase during a heat-exchange process, and in which the medium intended to flow around the outer surfaces of the tubes is a gas. The heat-exchanqer is particularly intended for use in industrial applications, particularly in corrosive environments. It is primarily intended for extracting heat from flue gases, e.g. heat from the flue gases of oil and coal fired power stations. Heat-exchangers intended for this purpose need to be robust and powerful. They are therefore preferably made of steel. When the heat-exchangers are to be used in corrosive environments, it is often necessary to coat the surfaces of the heat-exchanger with an impervious corrosion inhibitor, for example, an enamel, unless the heat-exchanger is constructed from a corrosion resistant material throughout. Consequently, the invention is particularly directed to tube heat-exchangers of the kind which incorporate batteries of heat-exchange fins and in which the fins are secured firmly by expanding the tubes, and which are made of steel and provided with impervious surface coatings of a damage-resistant substance, preferably enamel.

It is generally recognized that in the case of tube heat-exchangers in which liquid flows through the tubes and gas flows around the outer surfaces thereof, the gas transfers heat much less effectively than the liquid. Consequently, it is necessary to enlarge the outer surfaces of the tubes. The two most common ways of achieving this are:

(a) By providing helical flanges on the outside of the heat-exchanger tubes. The flanges are normally welded to the tubes, so as to eliminate the heat resistance at the juncture between flange and tube. In addition to rotational regenerative heat-exchangers for direct heat exchange between two gases, e.g., regenerative air heaters of the Ljunqstrom type, the most common type of heat-exchanger used industrially in conditions where an enlarged outer tube surface is required are those fitted with helically wound tubes, i.e. with helical fins along the tubes. Otherwise, tube heat-exchangers with smooth tubes are used. Since gas leakages readily occur in said rotating heat-exchangers, they have been replaced progressively with helical-tube type heat exchangers.

(b) By fitting batteries of flat surface-enlarging fins to the outer surfaces of the heat-exchanger tubes. The fins are often made to a standard design for several heat-exchanger tubes. These fin batteries are mostly used in apparatus intended for general ventilation (comfort) and similar purposes. Consequently, the tubes and fins of such heat-exchangers are given comparatively small dimensions and are also made of a soft material, such as cooper or aluminum. One commonly applied method of achieving good heat transfer between the tubes and the fins, i.e. good contact with high contact pressure at the junction therebetween, is to secure the fins to the tubes by expanding the tubes radially into engagement therewith. This can either be effected mechanically with the aid of a mandrel or a spherical body which is drawn through respective tubes, or hydraulically by pumping liquid under high pressure through the tubes. Both methods are based on expanding the tubes radiallY so that the material of the tube stretches beyond the elastic limit of the tube material, so as to obtain permanent deformation and a high contact pressure.

With regard to fin-batteries used with heat-transfer apparatus for general ventilation purposes and like purposes, it is relatively easy to secure the fins by expanding the tubes mechanically or hydraulically in the aforesaid manner. It will be appreciated that in the case of such apparatus, the tubes and fins have small dimensions and are made of soft materials, such as copper or aluminum. In addition, the fins are provided with resilient collars around the holes through which the heat-exchanger tubes pass. This facilitates expansion and ensures that a given contact pressure constantly prevails between the tubes and the fins. The collars also often serve as spacers between the fins.

Fin batteries of this kind, however, have not been utilized in the aforesaid industrial applications, despite the advantages to be gained over heat-exchangers equipped with helically wound tubes. These advantages include:

greater surface enlargement
lower pressure drop
more stable heat-exchanger body
cheaper heat-exchanger.

Thus, the more robust tube-exchanger required in industrial applications has primarily incorporated helically wound tubes, or in some cases smooth tubes. These tube heat-exchangers are mostly made of steel. There are several reasons why fin batteries of the aforesaid construction have not come into use industrially. For example, a number of difficulties and problems arise when fin batteries are to be made of steel, and particularly when they are to be provided with protective surface coatings. These problems are primarily as follows:

(a) It is more difficult to expand radially heat-exchange tubes which are made of steel. In order to expand the steel tubes hydraulically, it is necessary to use pressures of around 1000 bars in the case of tube thicknesses normally required in such heat-exchangers.

(b) It is difficult, if not impossible, to provide the steel fins with resilient collars around the holes through which the tubes pass. Among other things, the collars tend to crack.

(c) When providing the heat-exchanger surfaces with a protective covering, e.g. an enamel covering, it is difficult to ensure that the covering will be fully impervious, which is necessary in order to provide satisfactory protection against corrosion. In order for the enamel surface to be fully impervious, the surfaces of the heat-exchanger prepared to receive the enamel coating must be perfectly smooth and devoid of all cracks and other cavities. These surfaces should also be free of readily dislodged surface materials, such as welding slag or weld beads for example, capable of being knocked-off or otherwise removed when desooting the heat-exchanger or handling the same for some other reason, the removal of such surface materials being liable to leave cavities in the enamelled surface. It is not feasible to use resilient collars around the fin holes through which the tubes pass, since gaps and cracks around the collars would impair the enamelled surface. Such gaps and cracks cause, inter alia, bubbles to form in the enamel, which subsequently rupture and form discontinuities in the enamel as a result thereof. Even if they do not rupture, they are liable to cause imperfect surface covering and as a result, corrosion damage. Neither will this construction enable the fins to be fitted securely enough. It will be appreciated that flexing of the resilient collars creates cracks in the enamel coating.

SUMMARY OF THE INVENTION

Consequently, the object of this invention is to provide a heat exchanger which is not encumbered with the drawbacks of the prior art heat exchangers and which fulfills the aforementioned requirements and goals.

Specifically, an object of the invention is to provide an improved method effective for manufacturing such a heat exchanger.

These problems are overcome by the present invention with the aid of the fin battery construction in which the heat-exchanger fins in their region of contact with each heat-exchanger tube are made of plate-like material which is substantially planar and oriented in a plane extending at right angles to the longitudinal axis of respective tubes, and are constructed in a single plate-thickness, i.e. with the absence of a collar-like bend or any other bend in the fin material adjacent its surface of contact with the heat-exchanger tube.

The present invention provides a construction and method which avoids the formation of gaps between material of the fins and the tubes, which, in the prior art, provide hidden cavities for oil, moisture or air which when surface treating the fin-tube assembly, e.g. enamelling and firing the surface coverings in kilns at temperatures of around 800° C., give rise to gas bubbles therewith impairing the protective covering.

The present invention also provides firm attachment of the fins to the tubes without the need for resilient attachment elements and, in addition, enables reduction in the extent to which the tubes need be expanded radially in order to firmly fix the fins thereto.

The present invention provides a firm attachment of the fins to the tubes by forming cylindrical holes in the fins by machining, by cutting or grinding, and/or with the aid of a fine-punching method or with other methods which cause the fin surfaces in contact with the heat-exchanger tubes to extend parallel to the longitudinal axis of a respective tube along substantially the total axial extent of said holes throughout the thickness of the fin material. This solution ensures thermally conductive contact between the materials of the fin and the tube over the whole surface and about the entire interior periphery of the hole. If the tube accommodating holes are punched in the fins bY means of simple conventional hole-punching methods, the wall of the hole obtains a slightly conical configuration. This results in a gap on the tube-wall side, preventing full thermally conductive contact therewith. These gaps are also liable to cause defects when enamelling the heat exchanger. However, by the present invention these and other deleterious effects are avoided, and a secure engagement between the fins and the tubes is obtained with a reduction in the extent to which the tubes need be expanded.

The present invention produces suitable tube and fin dimensions for applying the invention to steel fin heat exchangers.

The present invention also produces a heat exchanger particularly adapted to be mounted in an industrial plant.

The present invention provides an improved method for assembling a heat exchanger embodying the advantages set forth above.

In a preferred method, the fins are fixed securely to the heat exchanger by hydraulically expanding the tubes in a manner to enlarge the outer peripheral surfaces thereof. One particular advantage afforded by this hydraulic expansion of the tube is that the tube is slightly bulged outwards in the fin interspaces. This contributes towards achieving firm securement of the fins while at the same time providing the additional possibility of checking the extent of the expansion, by measuring the free tube-sections between the fins.

The invention produces completely smooth surfaces on the fins and the tubes in the heat-exchanger, these surfaces being particularly suitable for surface treatment purposes, including enamelling. The heat-exchanger obtains a large specific heat-transfer surface or area and produces a low pressure drop for the gas which is to flow therethrough. It can also be readily cleaned from coatings or other deposits which are liable to impede the transfer of heat. Since all parts of the heat-exchanger can be reached readily with various cleaning devices, the flow passages will not become blocked by foreign bodies or substances. The exchanger can also be readily produced in large numbers and at low cost.

The present invention also contemplates producing a heat exchanger which has been subjected to surface treatment, e.g. enamelling, which enables the heat-exchanger to be used in corrosive environments.

BRIEF DESCRIPTION OF THE DRAWINGS

An embodiment of a heat-exchanger made according to the invention will now be described with reference to the accompanying drawings, in which.

DESCRIPTION OF THE PREFERRED EMBODIMENTS

Figure 1:
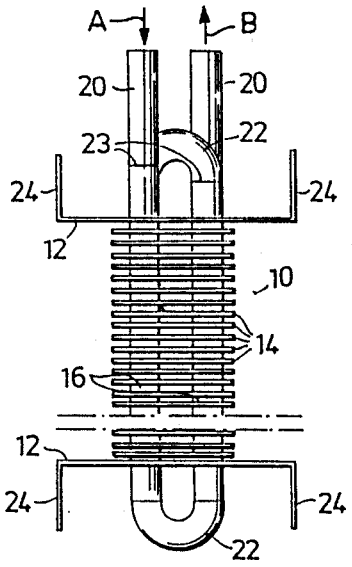
FIG. 1 is a top plan view of a heat-exchanger made in accordance with the invention, the length of which has been shortened for illustration purposes.
Figure 2:
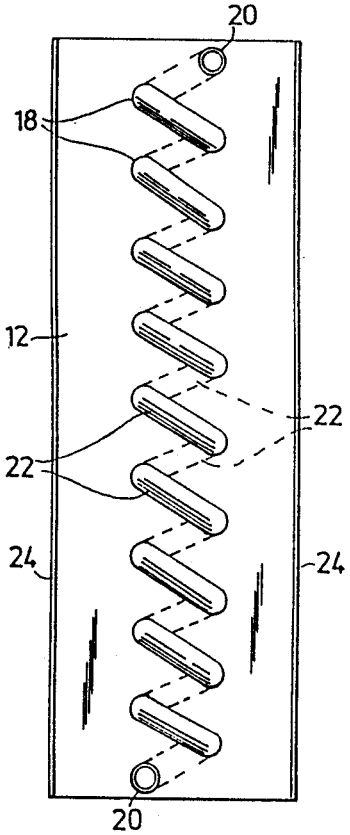
FIG. 2 is a side view of the heat-exchanger.
Figure 3:
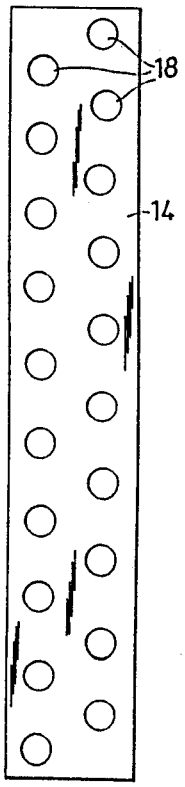
FIG. 3 illustrates one of the fin plates embodied in the heat-exchanger

In FIG. 1, there is illustrated a heat-exchanger 10 comprising end plates 12, heat-transfer fins 14 and heat-exchange tube sections 16. The tube sections extend through holes 18 in the fins and in the end plates, so as to project from the series of ifns beyond the end plates at opposite ends. The positions of the holes and the tubes in the illustrated embodiment are illustrated in FIGS. 2 and 3. In the illustrated embodiment of the heat-exchanger, two of the heat-exchange tube sections are provided with connecting sections 20 externally of the end plates, while the remaining tubes are provided with tubular elbows 22 which are curved through 180° and which connect the tube sections together in pairs to form a serpentine passage. The tube elbows 22 and the connecting sections 20 may be joined to the heat exchange tube sections 16 by weld joints 23.

The end plates 12 are provided with right-angle flanges 24 which extend along the longitudinal sides of the end plates. The flanges afford increased stability to the end plates and to the heat-exchanger. If considered suitable, similar flanges can also be arranged on the short sides of the end plates. The flanges are used for mounting the heat-exchanger in an industrial plant, i.e. for connecting the heat-exchanger to duct systems and/or for connecting a plurality of heat-exchange units sequentially one after the other or in parallel to construct a larger heat-exchanger battery.

Figure 4:
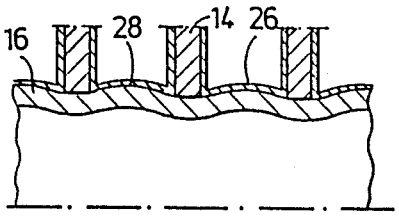
FIG. 4 is a sectional view of part of a heat-exchanger tube section provided with fins according to the invention, the heat-exchanger tube having been expanded hydraulically in a manner to firmly secure the fins thereto.

FIG. 4 is a cut-away detail view of a section of the tube-fin arrangement and illustrates how fins 14 are firmly secured to a heat-exchanger tube 16 by hydraulically expanding the tube. At least the marginal portions of the plate-like material forming the fins 14 which surround the holes 18 are oriented in a plane perpendicular to the longitudinal axis of the tube section passing through the hole, so as to provide an interior surface confronting the tube which has an extent or depth corresponding to the thickness of the fin material. FIG. 4 shows that the tube and the fins are coated with a protective enamel layer 26. It will also be seen from the figure that the wall of the tube in the space between mutually adjacent fins is slightly bulged, as shown at 28, these bulges being formed when expanding the tube hydraulically.

The radial extent of the bulges depends on the individually prevailing circumstances, such as the material used and the dimension thereof. In the case of a tube having a diameter of 18 mm, the expansion is roughly 0.8 mm. The bulges thus formed assist in firmly securing the fins while affording, at the same time, an additional possibility of checking the expansion achieved, by measuring the diameter of the tube between the fins.

Figure 5:
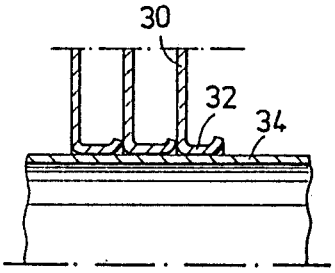
FIG. 5 is a sectional view of part of a heat-exchanger tube in a fin battery made according to prior art techniques.

For reasons of comparision, FIG. 5 illustrates a similar detail view of a conventional prior art finned heat-exchange tube used in conjunction with general ventilation apparatus (comfort ventilation). In this conventional construction, the fins 30 are provided with resilient collars 32 around the holes through which the heat-exchanger tubes 34 pass. Since the fins of this construction are thin and made of a soft material, e.g. aluminum, it has been possible to form the collars in a simple fashion from the fin material itself. In the illustrated case, the collars also serve as spacers between respective fins. The major purpose of the collars, however, is to ensure that a sufficient contact surface is obtained to provide satisfactory contact pressure between the heat-exchanger tube and the fins, so as to obtain satisfactory heat-transfer conditions. The fins have been secured in position by expanding the heat-exchanger tube. The expansion required to provide sufficient contact pressure is facilitated by the fact that the heat-exchanger tube has a small wall thickness and is made of a soft material, e.g. copper, and also by the fact that the collars provide a certain degree of resilience in the connection between the fins and the heat-exchanger tube.

When a comparison is made between a construction made according to the invention as illustrated in FIG. 4 and the prior art construction as illustrated in FIG. 5, it will be seen that the known construction cannot suitably be used in heat-exchangers which are to be provided with a protective surface coating, such as an enamel coating. Gaps, cracks and cavities around the collars 32 of the FIG. 5 construction would constitute obstacles to obtaining a fully satisfactory enamel surface. Similarly, the resiliency in the joint between the fins and respective tubes would result in the formation of cracks in the enamel.

No such cracks, etc. are to be found between fins and heat-exchanger tubes in the heat-exchanger construction according to the invention illustrated in FIG. 4. The surfaces of the fins and tubes of the heat-exchanger illustrated in FIG. 4 are substantially completely smooth, which when surface coating the surfaces with a corrosion-resistant protective coating, for example enamel, can result in an extremely durable and completely impervious surface layer. In addition, the fins are so firmly secured that no resilience or internal stress capable of damaging the enamel layer is to be found in the location where the fins join respective tubes. Another advantageous result of the rigiditY of this attachment is that the extent to which the heat-exchanger tubes need to be expanded radially in order to firmly secure the fins is much smaller than that to which the tubes of known heat-exchangers need to be expanded, either hydraulically or in some other way, in order to firmly secure the fin batteries to respective tubes.

Figure 6:
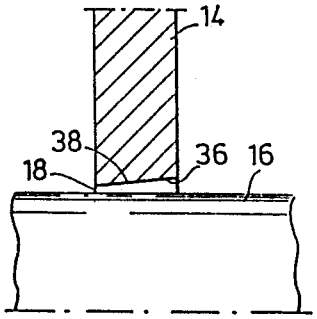
FIG. 6 illustrates part of a heat-exchanger tube in contact with a fin plate where the hole in the fin plate is formed by means of a conventional punching method.
Figure 7:
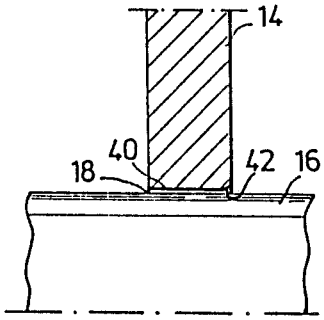
FIG. 7 illustrates part of a heat-exchanger tube in contact with a fin plate according to the invention, in which the hole in the fin plate has been formed by means of a fine-punching method.

FIGS. 6 and 7 show that the heat-exchanger made according to the invention can be improved still further in, inter alia, the aforementioned respects. This is achieved by so accurately forming the holes 18 in the fins for accommodating the heat-exchanger tubes in heat-transfer contact with the fins, that the contact surface against the heat-exchanger tubes in said holes in the fins is cylindrical and extends parallel to the longitudinal axis of the tubes along substantially the total axial extent of the holes. Preferably the holes are dimensioned relative to the outer diameter of the tube to provide close to a "sliding fit" therebetween. FIG. 6 illustrates how a hole punched in a fin in accordance with a conventional punching technique will produce a slightly conical wall surface 36. This conical hole-wall surface defines a gap 38 with the heat-exchanger tube 16 which can deteriorate the surface coating, e.g. an enamel coating in a manner readily understood.

With the aid of a more accurate fine-punching method, or some other accurate method, it is possible to provide holes having hole-walls 40 according to FIG. 7 which are cylindrical and parallel to the longitudinal axis of the tube, and therewith parallel to the original cylindrical surface of the tube along practically the whole depth of hole. A slight deviation 42 at the immediate location where the punch passes through the fin can be accepted, however. No gap, which may adversely affect the surface coating, e.g. enamel covering, is formed between the tube wall and the hole walls of the fins when forming the holes more accurately in accordance with FIG. 7. A highly durable and tough enamel surface can thus be obtained. The important heat transfer between the fins and the tubes is ensured since the contact surface therebetween, which has a uniformly distributed high contact pressure, is even greater subsequent to the hydraulic expansion of the tubes. In addition, the extent to which the heat-exchanger tubes need to be expanded in order to firmly secure the fins has been further reduced.

Examples of other accurate methods for the making of holes 14 with cylindrical walls are various machining methods, such as drilling, cutting or grinding. However, these methods are more time consuming and especially for long manufacturing runs more expensive. Therefore, the fine-punching method identified above is preferred.

The heat exchanger can be provided can be provided with a protective coating made of any material suitable for the application in question, although enamel is the most durable and resistant. Other coatings are electroplating, hot-dip galvanizing, aluminizing or a coating, for example, of epoxy paint.

The application of an enamel coating on a heat exchanger comprises the following operative steps:

cleaning
application of enamel material
(submersion in enamel material or float coating with fluid enamel material)
drying
firing
cooling In order to avoid bubble and crack formation in the enamel on the heat exchanger, special care must be taken of the drying and cooling steps in order to obtain an impermeable coating.

The drying is normally done from the outside at increased surrounding temperature or in a radiant heat oven. The surface layer will then dry out first and form a "skin", which impedes or inhibits the removal of the last remains of moisture at the root or base of the fins. This moisture may be surface-bonded to the surface of the enamel material particles or may be retained by capillary action between the fins and the tubes. Such retention further delays the moisture removal. The result is that bubbles are formed during the firing operation in the enamel layer. This is caused by the violent volume increase of the water when it is transformed to high temperature steam. (The firing temperature is above 800° C.).

According to the invention, the drying of the float coating of enamel material is performed from the inside out using the circulation tubes of the heat exchanger. A heated medium, for instance a hot gas, is passed in (arrow A in FIG. 1) through one of the circulation sections 20 or tube openings, passes through the circulation tubes emitting its heat to the tubes 16 and fins 14 and passes out (arrow B) at the other connection section 20 or tube opening. In this way, a reverse temperature gradient is obtained and the moisture is removed starting from the surface to which the coating is applied. All moisture is driven out, also from the unavoidable capillary passages between the fins 14 and the tubes 16. The hot gas may suitably be supplied through a collector pipe or manifold to several circulation tube sections or loops simultaneously.

The cooling of the heat exchanger must be slow, otherwise cracks will occur at the roots of the fins where they are connected to the tubes. According to the invention, the heat exchanger is cooled slowly (from a firing temperature of 800°–840° C. to 500° C. in 15 minutes). This corresonds to a cooling rate of about 20° a minute.

Preferably, the fins 14 and the end plates 12 are all aligned to register the holes formed therein for the insertion of the tube sections 16 through the accurately-formed holes 18 in the fins and the end plates. The tube sections are straight sections without bends or elbows, so that the sections may be threaded through the series of registered holes in the successive fins and end plates. When all of the tube sections are in place and the spacing between adjacent fins and the respective end plates is adjusted to the desired distance, the tubes are expanded, for example mechanically by drawing a mandrel or a spherical body through each tube section, or hydraulically by pumping liquid under high presure through the several tube sections. The expansion is sufficient to exceed the elastic limit of the material. The radial expansion of the individual tube sections assures a tight fit of each tube section within each of the accurately-formed holes. Since the several tube sections are each independently threaded through the holes in successive fins and end plates, the tubes are free to accommodate themselves to centering within the holes to assure intimate contact pressure between the tube and the plate throughout the entire circumference of the hole, as well as axially through the full thickness of the fin or end plate.

Preferably, the expansion of the tubes is performed hydraulically, with each tube section receiving the desired hydraulic pressure to insure intimate pressure contact of the outer surface of the tube section with the entire interior surface of the accurately formed holes. Hydraulic expansion insures uniformity in the application of expansion pressure throughout the tube section, while permitting the tube sections to find their precise centered position within the cylindrical holes.

When all the tube sections are firmly secured to the fins and end plates, the fins and end plates serve as a jig to hold the tubes in proper position for the subsequent welding operation in which the various straight tube sections are interconnected by elbows. The pattern of interconnecting may be selected to provide the desired flow path through the tube sections.

Prior to the present invention, it was considered necessary to prevent the temperature of the heat exchanger assembly from rising above the soft annealing temperature for the tube material (for steel 550°–600° C.) to avoid loss of heat transfer efficiency between the tubes and the fins. However, it has been discovered that neither the welding of the elbows nor the application of the enamel coating (at a temperature above 800° C.) adversely affects the heat transfer efficiency. The loss in efficiency is less than approximately 3% after enameling.

The method of the present invention avoids the generation of stresses in the tube sections and plates prior to the enameling operation. Since there are no latent stresses in the assembly, there is no tendency for any stresses to be released during the enameling operation, and the cracks and sloughing of material which has occurred in previously-known enameled heat exchangers is avoided, thereby reducing the risk of corrosion at sites of such cracks or sloughing of material.

The described embodiment illustrates one single tubular loop through the heat exchanger, with the inlet and outlet of mutually the same size. It will be understood, however, that the tubular loop can be divided into a plurality of loops, by connecting more connectors 20 in parallel instead of tube in series by the elbows 22. Such connectors may, of course, also be mounted adjacent either or both end walls.

A heat exchanger of the aforedescribed kind can be given extremely large dimensions. The tube length may be up to about 10 m, and the tubes can have a diameter up to about 75 mm. The tubes may have a wall thickness of at least up to approximately 5 mm. The thickenss of the flanges of fins can also be up to 5 mm. The end walls are preferably thicker than the fins. For example, the end wall thickness may be 5 mm and a corresponding fin thickness of about 1 mm. The heat exchanger according to the invention should, in respect of a number of applications be manufactured from steel, in order to fulfill requirements of temperature resistance, wear resistance and to obtain suitable properties for enamelling processes or other surface processes. Other metals may be used, however, when the heat exchanger is to be used in environments subject to lower thermal stresses.

Preferably, the slow cooling of the heat exchanger is done by passing a first cooling medium through the interiors of the circulation tubes, and gradually reducing the temperature of the medium. Preferably the exteriors of the tubes and the fins are also exposed to a cooling medium, which may be ambient air or a cooling spray, simultaneously with the interior cooling.

For most applications, the wall thickness for steel tubes should be 0.5 to 5.0 mm, preferably about 2 mm, while the thickness of steel fins mounted thereon should be 0.4 to 5.0 mm, preferably about 1.25 mm.

It will be understood that the invention is not restricted to the aforedescribed embodiment of a heat-exchanger according to the invention, and that modifications can be made within the scope of the following claims.

We claim:

1. A method of manufacturing a heat-exchanger comprising a circulation tube comprising a plurality of parallel tube sections, for conducting a first heat-transfer medium, and a series of surface-enlarging plate-like fins attached to the outer surface of said circulation tube sections so as to be exposed to contact with a second heat-transfer medium comprising the steps of:

forming a plurality of holes in the plate-like fins for accommodating and securing the circulation tube sections, the interior surface of said holes about the periphery of each hole being cylindrical and parallel to the longitudinal axis of the circulation tube section throughout the thickness of the plate-like fins, disposing the holes of fins of said series in registry and inserting said tube sections through said registered holes with their ends projecting from opposite ends of said series, and securing said fins to the periphery of the tube by expanding the walls of said tube sections into engagement with the interior surfaces of the holes in said fins throughout the thickness of the plate-like fins, expanding said tube sections beyond said holes at each side of said fins so that the marginal portion of each fin surrounding each hole therein is in contact with its associated expanded tube section and is oriented in a plane at right angles to the longitudinal axis of said tube section, thereby producing a heat exchanger assembly;

and applying a protective enamel coating encasing said fins and said tube sections after expanding the wall of said tube sections by the operative steps of cleaning the heat exchanger assembly, applying a coating of liquid enamel material thereon, and drying the enamel material by firing and cooling, characterized in that the drying operation is performed by passing a heat-exchange medium through at least one of the tube sections and out through another.

2. A method according to claim 1 including the step of, after expanding said tube sections, welding tube connectors to said tube sections beyond said series of plate-like fins to interconnect said tube sections to form at least one circulation path through said tube sections.

3. A method of manufacturing a heat-exchanger according to claim 1 wherein the step of expanding said tube sections is effected hydraulically by pumping pressure fluid into the interior of said tube sections under sufficient pressure to expand the tube section walls beyond their elastic limit.

4. A method of manufacturing a heat-exchanger according to claim 1 including the step of using steel tubing for said tube sections having a wall thickness in the range of about 0.5 to 5.0 mm, and using steel plate for said fins having a thickness in the range of about 0.4 to 5.0 mm.

5. A method of manufacturing a heat-exchanger according to claim 1 wherein said holes are formed by fine-punching the plate-like material of said fins.

6. A method of manufacturing a heat-exchanger according to claim 1 including the steps of providing end plates for mounting on said tube sections at the opposite ends of said series of fins, said end plates having outwardly-directed flanges for mounting said heat-exchanger in an industrial plant, forming holes in said end plates with interior surfaces about the periphery of the holes being in registry with the peripheries of the holes in said fins and parallel to the longitudinal axis of the tube sections, and inserting said tube sections into said holes so that said end plates are secured to said tube sections when its wall is expanded.

7. A method of manufacturing a heat-exchanger according to claim 6 with common end plates, and welding tube elbows to the ends of said tube sections so as to interconnect the tubes in said heat-exchanger in series, said tube elbows being welded to said tube ends externally of said end plates after expansion of said tubes to secure said fins and plates thereto.

8. A method of manufacturing a heat-exchanger according to claim 7 including the step of applying the protective coating encasing said fins, said tube sections, said elbows, and said end plates after said welding step.

9. A method of manufacturing a heat-exchanger according to claim 6 wherein said end plates holes are formed by fine-punching the material of the end plates.

10. A method according to claim 1 wherein said protective coating is a float coating of liquid enamel material and the cooling is performed slowly and simultaneously in the entire heat assembly.

11. A method according to claim 1 wherein the cooling is performed by passing a cooling medium through the tube sections, and gradually reducing the temperature of the cooling medium.

12. A method according to claim 1 wherein the cooling is performed by passing a first cooling medium through the interiors of the tube sections, and exposing the fins and the exteriors of the tube sections simultaneously to a second cooling medium.

13. A method of manufacturing a heat-exchanger comprising a circulation tube comprising a plurality of parallel steel tube sections having a wall thickness in the range of 0.5 to 5.0 mm, for conducting a first heat-transfer medium, and a series of surface-enlarging plate-like fins attached to the outer surface of said circulation tube sections so as to be exposed to contact with a second heat-transfer medium comprising the steps of:

fine-punching a plurality of holes in steel plate material having a thickness in the range of about 0.4 to 5.0 mm to produce said fins for accommodating and securing the circulation tube sections, the interior surface of said holes about the periphery of each hole being cylindrical and parallel to the longitudinal axis of the circulation tube section throughout the thickness of the plate-like fins, disposing the holes of fins of said series in registry and inserting said steel tube sections through said registered holes with their ends projecting from opposite ends of said series, and securing said fins to the periphery of the tube sections by expanding the walls of said tube sections into engagement with the interior surfaces of the holes in said fins throughout the thickness of the plate-like fins, expanding said steel tube sections beyond said holes at each side of said fins so that the marginal portion of each fin surrounding each hole therein is in contact with its associated expanded tube section and is oriented in a plane at right angles to the longitudinal axis of said tube section, applying an enamel coating material encasing said fins and said tube sections after expanding the wall of said tube sections thereby providing a coated assembly, without welding the fins to the tube sections, subjecting the coated assembly to a firing temperature in excess of the soft annealing of the steel tube sections, and effecting controlled cooling of the heated assembly to solidify the enamel coating material.

* * * * *

UNITED STATES PATENT AND TRADEMARK OFFICE

CERTIFICATE OF CORRECTION

PATENT NO. : 4,970,770

DATED : November 20, 1990

INVENTOR(S) : Gosta Jansson; Berndt Wadell; Per-Olof Jakobsson

It is certified that error appears in the above-identified patent and that said Letters Patent is hereby corrected as shown below:

ON THE TITLE PAGE:
In the Headings, insert the following:

--[73] Assignee: Flakt AB, Nacka, Sweden--;

--[30] Foreign Application Priority Data
Feb. 13, 1986 [SE] Sweden .....8600633-5
Jul. 9, 1986 [SE] Sweden .....8603057-4--

Signed and Sealed this

Twenty-first Day of April, 1992

*Attest:*

HARRY F. MANBECK, JR.

*Attesting Officer*

*Commissioner of Patents and Trademarks*